US005473921A

United States Patent [19]

Goldman

[11] Patent Number: 5,473,921

[45] Date of Patent: Dec. 12, 1995

[54] COMBINATION LOCK WITH ARRANGEMENT FOR DEFEATING AUTOMATIC DIALER

[75] Inventor: Ilan Goldman, Herzliya, Israel

[73] Assignee: Ilco Unican Inc., Montreal, Canada

[21] Appl. No.: 255,313

[22] Filed: Jun. 7, 1994

[30] Foreign Application Priority Data

Jun. 8, 1993 [CA] Canada ..... 2097992

[51] Int. Cl.[6] ..... E05B 15/00

[52] U.S. Cl. ..... 70/333 R; 70/295; 70/332; 70/444; 292/DIG. 22

[58] Field of Search ..... 70/295, 333 R, 70/333 A, 327, 386, 442, 446, 443, 444, 445, 329, 332, 320, 210, 213, 220, 224; 292/DIG. 22

[56] References Cited

U.S. PATENT DOCUMENTS

| | | | |
|---|---|---|---|
| 2,308,382 | 1/1943 | McDermott | 292/DIG. 22 |
| 2,408,670 | 10/1946 | McDermott | 292/DIG. 22 |
| 3,104,538 | 9/1963 | Roberts et al. | 70/333 R |
| 3,699,789 | 10/1972 | Potzick | 70/329 |
| 3,980,161 | 9/1976 | Mauldin | 188/188 |
| 4,142,388 | 3/1979 | Phillips et al. . | |
| 4,831,851 | 5/1989 | Larson . | |
| 4,904,984 | 2/1990 | Gartner et al. . | |
| 5,061,923 | 10/1991 | Miller et al. | 70/278 |
| 5,257,520 | 11/1993 | Miller | 70/333 R |
| 5,305,695 | 4/1994 | Lichter | 70/332 |
| 5,343,723 | 9/1994 | Miller et al. | 70/333 R |

FOREIGN PATENT DOCUMENTS 0519755 6/1992 European Pat. Off. .

*Primary Examiner*—Darnell M. Boucher
*Attorney, Agent, or Firm*—Fishman, Dionne & Cantor

[57] ABSTRACT

A circular rotating member, having an outer peripheral surface, is rotatably mounted in a ring member. The rotating member includes an elongated central slot and four peripheral slots extending inwardly from the peripheral surface of the rotating member and spaced at 90 degrees from each other. The key of the combination lock extends into the central elongated slot, and a ball bearing is carried in each of the peripheral slots of the rotating member. The inner surface of the ring member is substantially identical to the outer peripheral surface of the rotating member but the inner surface of the ring member includes, additionally, two cut-outs. Thus, when the ring member is driven to rotate at a high speed by an automatic dialer, the ball bearing will be driven by centrifugal force into the cut-out whereby to prevent further rotation of the dial to thereby block the lock.

7 Claims, 3 Drawing Sheets

COMBINATION LOCK WITH ARRANGEMENT FOR DEFEATING AUTOMATIC DIALER

BACKGROUND OF INVENTION

1. Field of Invention

The invention relates to a combination lock having a means for defeating an automatic dialer. More specifically, the invention relates to such a combination lock wherein the defeating means comprises means for detecting the rotational speed of the spindle or shaft of the dial of the combination lock, and for blocking the combination lock when the speed of rotation exceeds a predetermined maximum.

2. Description of Prior Art

Combination locks are known in the art as illustrated in, for example, U.S. Pat. No. 4,142,388, Phillips et al, Mar. 6, 1979, U.S. Pat. No. 4,904,984, Gartner et al, Feb. 27, 1990 and U.S. Pat. No. 4,831,851, Larson, May 23, 1989. These are, of course, only some of the combination locks available in the art.

One of the problems which is faced by combination locks is that they can be defeated by automatic dialers. The automatic dialers comprise a computer controlled stepper motor which grasps the rotary dial of a combination lock and dials every possible combination of the combination lock at high speeds. With every possible combination being dialed, the correct combination for opening the lock will also be dialed. Accordingly, the lock can be opened without having knowledge of the combination.

Although this automatic dialer is very useful for legitimate owners of combination locks who have either lost or forgotten the combination, unfortunately, it can also be used by people wishing to make unlawful entry through a combination lock. With the high dialing speeds possible with the automatic dialer, the dialer can dial all possible combinations of even a combination lock having three tumbler wheels and a 100 number dial within twenty to thirty hours. Thus, a person wishing to make unlawful entry can place the automatic dialer on a combination lock in the late afternoon and return early next morning when there is a good chance that the lock will have been opened. Certainly, if the automatic dialer is left for a full weekend, the lock will definitely be opened before the end of the weekend.

In order for the automatic dialer to be useful, it must perform the dialing at high speeds. This means that the shaft or spindle of the dial of the combination lock must be rotated at a high speed.

SUMMARY OF INVENTION

It would therefore be possible, in accordance with the invention, to defeat an automatic dialer by simply detecting the speed of rotation of the shaft or spindle of the dial and taking appropriate action when a predetermined maximum speed has been detected.

It is therefore an object of the invention to provide a combination lock which overcomes problems of the prior art.

It is a more specific object of the invention to provide a combination lock which includes means for defeating an automatic dialer.

It is an even more specific object of the invention to provide a combination lock which includes a means for detecting the rotational speed of the shaft or spindle of the dial of the combination lock, and to take appropriate action when the speed exceeds a predetermined maximum.

It is an even more specific object of the invention to provide such a means wherein, when a speed greater than the predetermined maximum is detected, the means takes action to block the lock.

In accordance with the invention, there is provided a combination lock which includes means for defeating an automatic dialer, the means for defeating comprising a means for detecting the rotational speed of the shaft or spindle of the dial of the combination lock, the means further being adapted to block the lock when it detects a rotational speed of such shaft or spindle which exceeds a predetermined minimum.

In accordance with a particular embodiment of the invention there is provided for use in a combination lock, said combination lock including a rotary dial, a shaft extending from and rotatable with said dial, a cam wheel mounted on the free end of said shaft and a key for keying said cam wheel to said shaft whereby said key and said cam wheel rotate with the rotation of said shaft;

a means for defeating a high speed automatic dialer, comprising:

a ring member having an outer surface and an inner surface;

a rotating member, having an outer peripheral surface, and being rotatably mounted in said ring member;

said rotating member including a central elongated slot;

said key extending into said central elongated slot;

said rotating member further including at least one peripheral slot extending from said peripheral surface into the body of said rotating member;

a ball bearing carried in said peripheral slot;

the inner surface of said ring member being substantially identical to the outer peripheral surface of said rotating member, the inner surface of said ring member including additionally at least one cut-out;

whereby, when said rotating member is driven to rotate at a high speed by said automatic dialer, said ball bearing will be driven by centrifugal force into said cut-out whereby to prevent further rotation of said dial to thereby block said lock.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
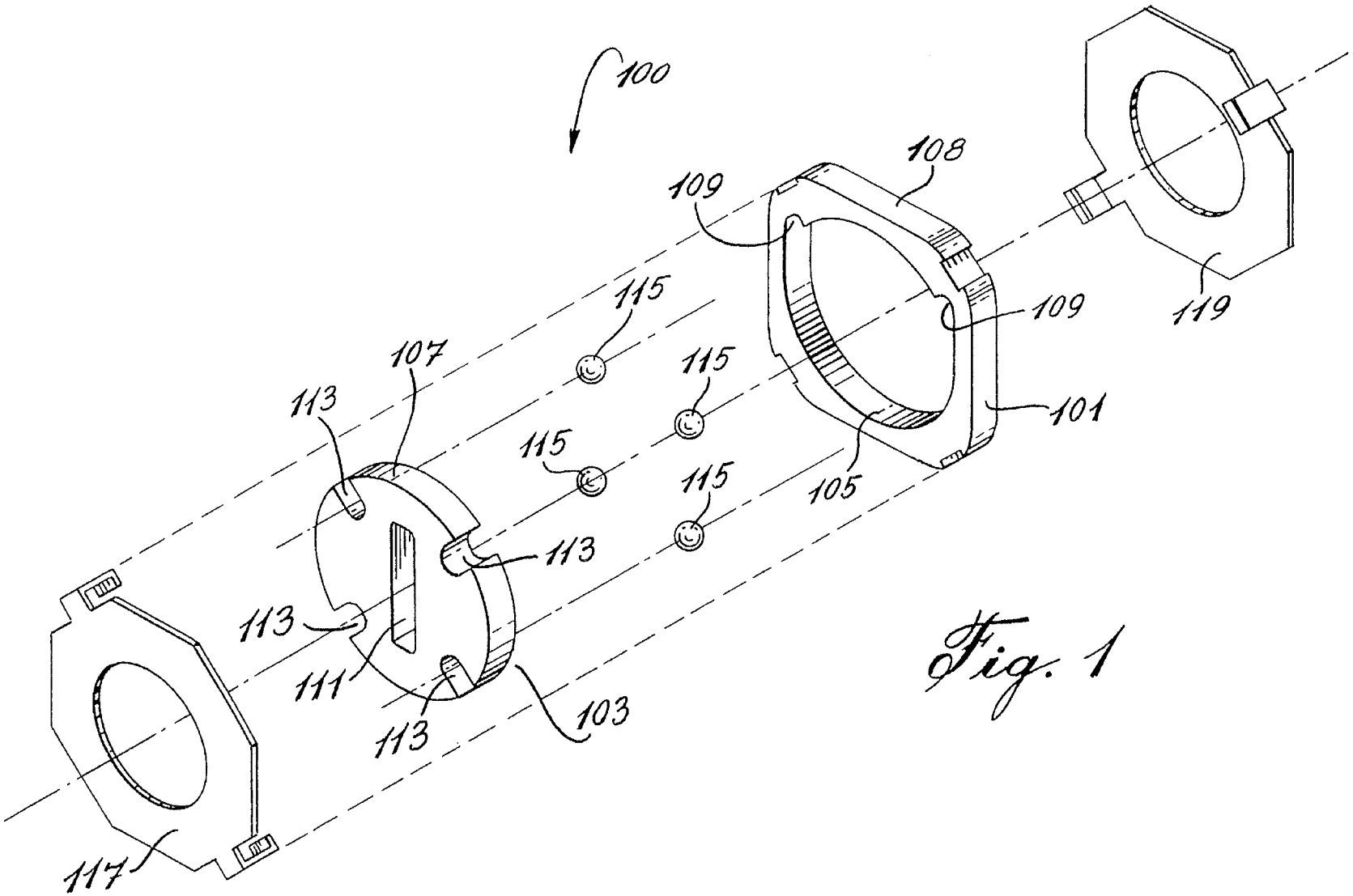
FIG. 1 is an exploded view of the defeating means.

Turning now to FIG. 1, the defeating means, illustrated generally at 100, comprises a ring member and a rotating member 103 which is mounted for rotation within the ring member 101. The inner surface of the ring member is of substantially the same shape as the outer, peripheral surface 107 of the rotating member 103 except that the ring member includes at least one and preferably two cut-outs 109. As will be explained below, the cut-outs must be at the top end of the ring member when the combination lock is operationally mounted, so that the top end of the ring member preferably includes a marking such as that illustrated at 1088 in FIG. 1.

The rotating member 103 includes a central slot 111, which extends along one diameter of the member 103, and at least one, but preferably four, peripheral slots 113. The central slot 111 extends completely through the rotating member 103. Each peripheral slot extends from the peripheral, or outer, surface 107 of the member 103 and radially inwardly into the body of the rotating member 103. In the illustrated embodiment, the slots 113 are spaced 90 degrees apart.

Figure 3:
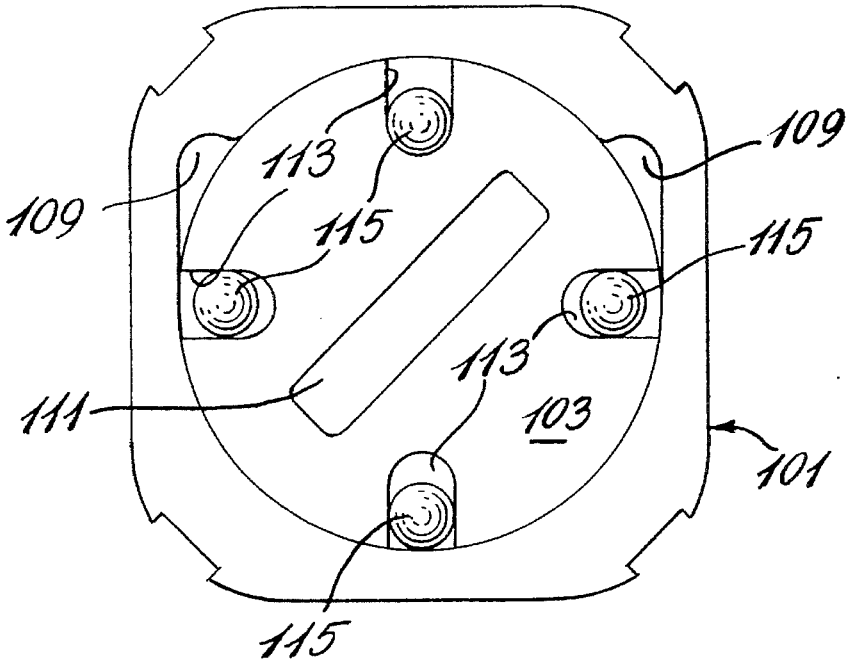
FIG. 3 illustrates the state of the defeating means when the combination lock is subject to manual dialing.
Figure 4:
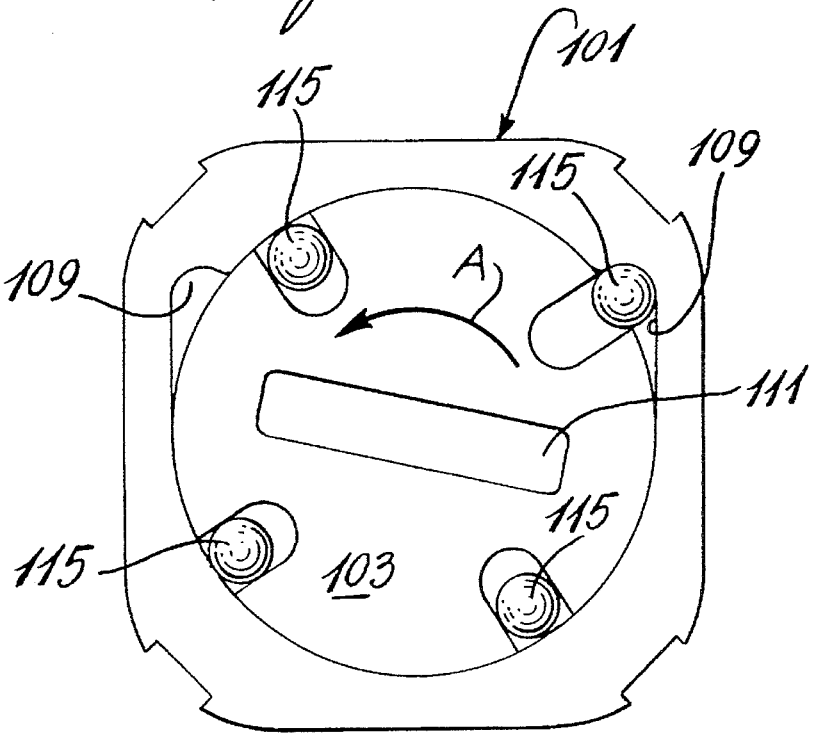
FIG. 4 illustrates the state of the defeating means when the combination lock is subject to automatic dialing.

The defeating means also includes ball bearings 115, there being one ball bearing for each peripheral slot. As seen in FIGS. 3 and 4, each ball bearing 115 is carried by a respective peripheral slot 113.

Figure 2:
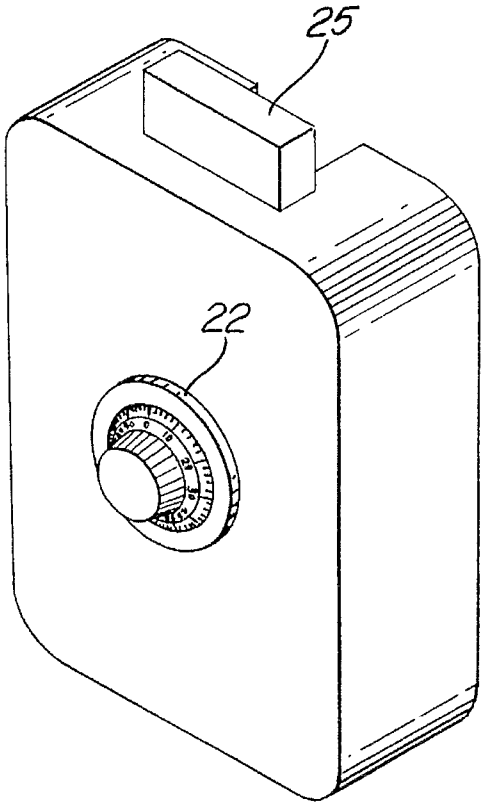
FIG. 2 is an exploded view of a combination lock showing how the defeating means is mounted therein.

Turning now to FIG. 2, the combination lock includes a case 121, having end walls and side walls and a dial 122 on a front wall of the case 121. The combination lock also includes a cover plate 123. Latch 125 extends out of the case 121 as is well known in the art.

The cover 123 includes, on the inner surface thereof, a depression 127. The depression 127 has substantially the same shape and depth as the shape and height of the defeating means 100. The outer shape of the means 100 is not of a rounded shape so that when the means 100 is mounted in the depression 127, it will not be rotatable within the depression. However, the rotating means 103 will be rotatable within the ring member 101 when the means 100 is mounted in the depression 127.

Mounted in the casing, as is well known in the art, is a shaft or spindle which extends from the dial 122. As is well known in the art, and as illustrated in the '388 patent above-referred to, mounted on the shaft are a plurality of tumbler wheels, for example, the wheels 41, 42 and 43 in the '388 patent. Mounted at the end of the shaft or spindle 25 of the '388 patent is a cam or driver 29. The cam or driver 29 is keyed to the spindle or shaft 25 at 31 in the '388 patent.

As seen in the '984 patent, and especially in FIGS. 2 and 3, cam wheel 16 is mounted on shaft or spindle 15. Four recesses (unnumbered), spaced 90 degrees apart from each other, are provided for keying the cam 16 to the shaft 15. In accordance with the prior art, the key would extend into only one of these inserts.

Figure 5:
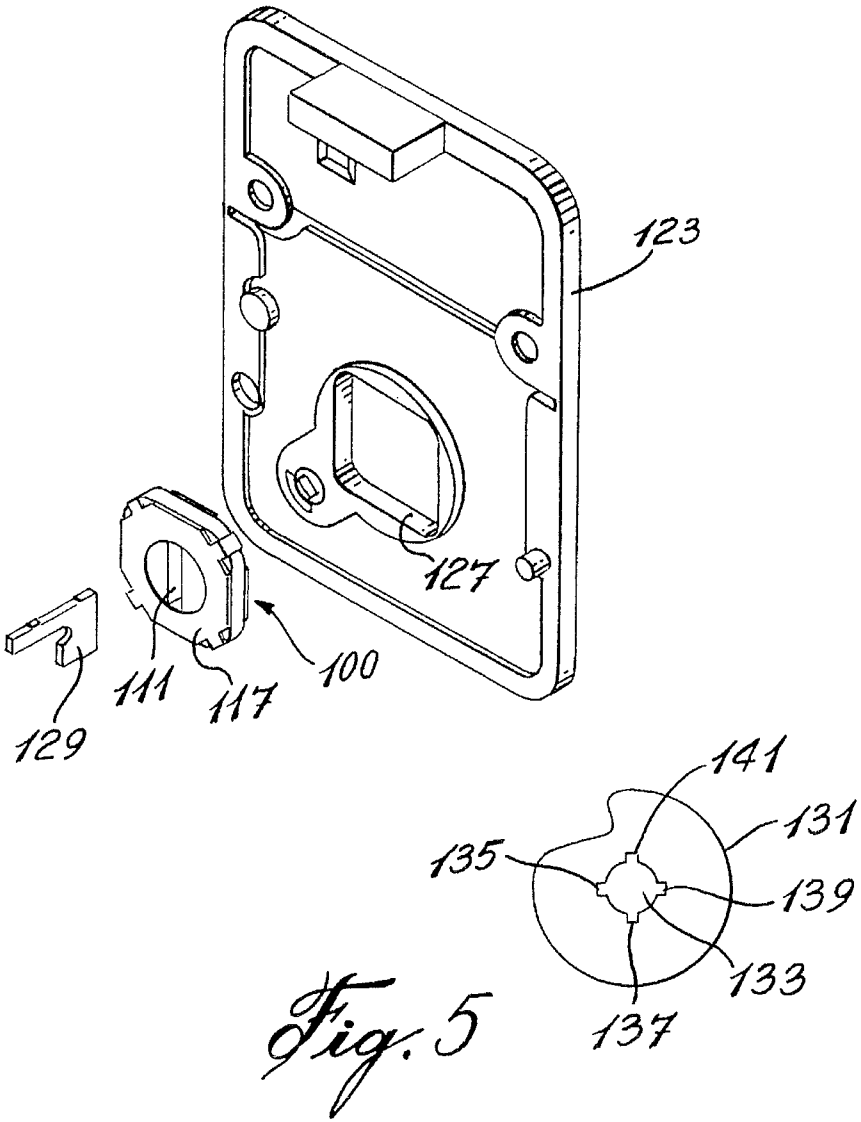
FIG. 5 illustrates, schematically, a cam of the combination lock.

This is also shown in FIG. 5 herein wherein cam 131 has a central opening 133 with recesses 135, 137, 139 and 141. Key 129 would be inserted in recesses 135 and 139 or 137 and 141.

In accordance with the present invention, the key 129 (in FIG. 2) would extend across two aligned inserts, for reinforcement, and would be made of a material of high strength such as steel. The reason for this will be explained below.

The key 129 extends into the slot 111 so that the rotating member 103 will rotate with rotation of the dial 122 through rotation of the dial shaft or spindle which will cause rotation of the key 129.

Turning now to FIGS. 3 and 4, when the dial is rotated by hand, each ball bearing will remain in its respective peripheral slot 113 so that it remains possible for the rotating member 103 to rotate within the ring member 101. However, if the dial is rotated by an automatic dialer at high speeds, then a ball bearing will be driven outwardly, due to centrifugal force and into one or other of the cut-outs 109. In FIG. 4, due to the fact that rotation is in the direction of the arrow A, that is, counter-clockwise, a ball bearing will be driven into the right-hand side cut-out 109. With the ball bearing in this position, it can be seen that it is no longer possible to rotate the rotating member 103. Because of the connection between the rotating member, through key 129, to the shaft of the dial 122, it will no longer be possible to rotate the dial so that no further combinations can be dialed. Accordingly, the lock will be blocked.

It can now be seen why the cut-outs 109 have to be located at the top end of the ring member. If they were at the bottom end, then the ball bearings would fall into the cut-outs due to the forces of gravity so that it would not be possible to rotate the dial at any speed.

The speed at which the ball bearing will be driven into the cut-outs by the centrifugal force is a function of the location of the cut-outs 109. That is, the higher the cut-outs are placed, the greater is the required speed for driving a ball bearing into the cut-out.

The speed of driving the ball bearings into the cut-out can also be determined by the angles of the peripheral slots 113.

It can also now be seen why the key has to be of a material of high strength and reinforced. When the lock is blocked, as in the position in FIG. 4 hereof, the automatic dialer will still attempt to continue dialing. If the key were not strong and reinforced, then the key would break off and it would be possible once again for the automatic dialer to continue dialing.

Although several embodiments have been described, this was for the purpose of illustrating, but not limiting, the invention. Various modifications, which will come readily to the mind of one skilled in the art, are within the scope of the invention as defined in the appended claims.

I claim:

1. For use in a combination lock, said combination lock including a rotary dial, a shaft extending from and rotatable with said dial, a cam wheel mounted on the free end of said shaft and a key for keying said cam wheel to said shaft whereby said key and said cam wheel rotate with the rotation of said shaft;

a means for defeating a high speed automatic dialer, comprising:

a ring member having an outer surface and an inner surface;

a rotating member, having an outer peripheral surface, and being rotatably mounted in said ring member;

said rotating member including a central elongated slot;

said key extending into said central elongated slot;

said rotating member further including at least one peripheral slot extending from said peripheral surface into the body of said rotating member;

a ball bearing carried in said peripheral slot;

the inner surface of said ring member being substantially identical to the outer peripheral surface of said rotating member, the inner surface of said ring member including additionally at least one cut-out;

whereby, when said rotating member is driven to rotate at a high speed by said automatic dialer, said ball bearing will be driven by centrifugal force into said cut-out whereby to prevent further rotation of said dial to thereby block said lock.

2. A combination lock as defined in claim 1 and further including a front cover and a rear cover, said front cover and said rear cover being mounted on different sides of said ring member to retain the rotating member in said ring member.

3. A combination lock as defined in claim 2 wherein the inner surface of said ring member includes two spaced cut-outs.

4. A combination lock as defined in claim 3 wherein said rotating member comprises four peripheral slots, the peripheral slots being spaced at 90 degrees from each other.

5. A combination lock as defined in claim 4 wherein the outer surface of said rotating member is circular.

6. A combination lock as defined in claim 5 wherein the outer surface of said ring member is non-circular.

7. A combination lock as defined in claim 6 wherein said combination lock is housed in a case having a front wall and side walls, said dial being mounted on the front wall of the case and said shaft extending inwardly into the case;

and further including a cover plate to be mounted on said case;

a depression in the interior surface of said cover;

said defeating means being non-rotatably mounted in said depression.

* * * * *